US009962842B2

(12) United States Patent
Komori et al.

(10) Patent No.: US 9,962,842 B2
(45) Date of Patent: May 8, 2018

(54) SLIT BLADE BLOCK AND ELECTRIC RAZOR HAVING SLIT BLADE BLOCK

(71) Applicant: Panasonic Intellectual Property Management Co., Ltd., Osaka (JP)

(72) Inventors: Shunsuke Komori, Shiga-ken (JP); Hiroaki Shimizu, Shiga-ken (JP); Masaaki Sato, Shiga-ken (JP); Toshio Ikuta, Shiga-ken (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 34 days.

(21) Appl. No.: 14/653,691

(22) PCT Filed: Dec. 10, 2013

(86) PCT No.: PCT/JP2013/007262
§ 371 (c)(1),
(2) Date: Jun. 18, 2015

(87) PCT Pub. No.: WO2014/103207
PCT Pub. Date: Jul. 3, 2014

(65) Prior Publication Data

US 2015/0352736 A1 Dec. 10, 2015

(30) Foreign Application Priority Data

Dec. 27, 2012 (JP) ..... 2012-286276

(51) Int. Cl.
*B26B 19/00* (2006.01)
*B26B 21/14* (2006.01)
(Continued)

(52) U.S. Cl.
CPC ..... *B26B 19/042* (2013.01); *B26B 19/10* (2013.01); *B26B 19/12* (2013.01); *B26B 19/42* (2013.01)

(58) Field of Classification Search
CPC ..... B26B 19/042; B26B 19/12; B26B 19/10; B26B 19/42
(Continued)

(56) References Cited

U.S. PATENT DOCUMENTS 2,240,264 A * 4/1941 Muros ..... B26B 19/042 30/43.92
2,262,388 A * 11/1941 Dalkowitz ..... B26B 19/042 30/43.92
(Continued)

FOREIGN PATENT DOCUMENTS

JP 10-323463 A 12/1998
JP 10323463 A * 12/1998
(Continued)

OTHER PUBLICATIONS

European Search Report issued in European Application No. 13869467.4 dated Nov. 12, 2015.
(Continued)

*Primary Examiner* — Ghassem Alie
*Assistant Examiner* — Bharat C Patel
(74) *Attorney, Agent, or Firm* — McDermott Will & Emery LLP

(57) ABSTRACT

This slit blade block includes multiple comb teeth adjacent to multiple outer blade pieces. Each comb tooth has a leading end surface, and a protruding part protruding in a direction away from the outer blade pieces. The protruding parts include an apical part that is the outermost end in said direction away from the outer blade pieces. The leading end surfaces of the protruding parts are positioned between the
(Continued)

leading end surfaces and the base end surfaces of the adjacent outer blade pieces. Length L1 in the height direction, defined by the apical part of the protruding parts and the leading end surfaces of the protruding parts, is less than or equal to thickness L2 of the outer blade pieces, defined by the leading end surface and the base end surface of the outer blade pieces.

6 Claims, 11 Drawing Sheets

(51) Int. Cl.
*B26B 21/52* (2006.01)
*B26B 19/04* (2006.01)
*B26B 19/12* (2006.01)
*B26B 19/10* (2006.01)
*B26B 19/42* (2006.01)

(58) Field of Classification Search
USPC ..... 30/43.3, 62, 529
See application file for complete search history.

(56) References Cited

U.S. PATENT DOCUMENTS 3,290,775 A 12/1966 Tolmie
3,834,017 A * 9/1974 Tolmie ..... B26B 19/42 30/34.2
4,003,130 A * 1/1977 Rookus ..... B26B 19/42 30/34.2
5,706,582 A * 1/1998 Hosokawa ..... B26B 19/046 30/34.2
5,946,806 A * 9/1999 Watanabe ..... B26B 19/042 30/346.51
6,073,348 A * 6/2000 Shiba ..... B26B 19/046 30/34.1
6,082,005 A * 7/2000 Tezuka ..... B26B 19/02 30/34.1
6,293,017 B1 * 9/2001 Sato ..... B26B 19/10 30/346.51
6,684,509 B1 * 2/2004 Best ..... B26B 19/102 30/34.1
6,889,437 B2 * 5/2005 Bader ..... B26B 19/10 30/43.1
7,730,621 B2 * 6/2010 Komori ..... B26B 19/384 30/346.51
8,011,102 B2 * 9/2011 Sato ..... B26B 19/046 30/346.51
9,044,868 B2 * 6/2015 Eichhorn ..... B26B 19/042
2005/0016002 A1 * 1/2005 Fukutani ..... B26B 19/10 30/527
2005/0274019 A1 * 12/2005 Inoue ..... B26B 19/10 30/43.7
2006/0225290 A1 10/2006 Bader et al.
2012/0055025 A1 * 3/2012 Pohl ..... B26B 19/04 30/34.1

FOREIGN PATENT DOCUMENTS

JP 2002-515315 A 5/2002
JP 2007-506492 A 3/2007

OTHER PUBLICATIONS

English Translation of International Preliminary Report on Patentability issued in International Application No. PCT/JP2013/007262 dated Jun. 30, 2015.
International Search Report issued in PCT/JP2013/007262, dated Mar. 18, 2014, with English translation.

* cited by examiner 30
40
43
41, 42
54
51
53
53A
55
52
41
42
60
83
77
70
80
81
74
76
72, 73
50
100
75
71
102, 103
104
105
ZC
110
115
113
101
90
93
94
95
92
92A
92B
91
31
111
112
114
96
97
ZB
ZA

SLIT BLADE BLOCK AND ELECTRIC RAZOR HAVING SLIT BLADE BLOCK

RELATED APPLICATIONS

This application is the U.S. National Phase under 35 U.S.C. § 371 of International Application No. PCT/JP2013/007262, filed on Dec. 10, 2013, which in turn claims the benefit of Japanese Application No. 2012-286276, filed on Dec. 27, 2012, the disclosures of which Applications are incorporated by reference herein.

TECHNICAL FIELD

The present invention relates to a slit blade block of an electric razor.

BACKGROUND ART

FIG. 12 is a cross-sectional view of a conventional slit blade block 300.

The slit blade block 300 includes a slit outer blade 310, a slit inner blade 320, and a comb component 330. The slit outer blade 310 includes outer blade pieces 311. When accommodated in the slit outer blade 310, the slit inner blade 320 oscillates relative to the slit outer blade 310. The slit inner blade 320 includes inner blade pieces 321. The comb component 330 accommodates the slit outer blade 310 and the slit inner blade 320. The comb component 330 includes comb teeth 331 (e.g., refer to patent document 1).

PRIOR ART DOCUMENT

Patent Document

Patent Document 1: Japanese National Phase Laid-Open Patent Publication No. 2002-515315

SUMMARY OF THE INVENTION

In the slit blade block 300, each of the comb teeth 331 includes a peak 332. The peaks 332 and the slit outer blade 310 are located at opposite sides of the slit inner blade 320. When an electric razor having the slit blade block 300 is used, the distance is relatively large between the peaks 332 of the comb teeth 331 and the skin SK of the user. Thus, it is difficult for the comb teeth 331 to lift up long whiskers (hair) lying on the skin SK. This may result in failure to shorten long whiskers (hair).

It is an object of the present invention to provide a slit blade block configured to be capable of further shortening long whiskers (hair) and an electric razor having the slit blade block.

One aspect of the present invention is a slit blade block of an electric razor that includes a slit outer blade including a plurality of outer blade pieces, a slit inner blade including a plurality of inner blade pieces, and a comb component including a plurality of comb teeth adjacent to the outer blade pieces. When the slit inner blade, which is accommodated in the slit outer blade, moves relative to the slit outer blade, the outer blade pieces and the inner blade pieces cut hair. Each outer blade piece includes a basal surface opposed to the slit inner blade and a distal surface located at a side opposite to the basal surface. Each of the comb teeth includes a distal surface and a projection that projects in a direction parting from the outer blade pieces. Each projection includes a peak, which is an outermost end in the parting direction. The distal surface of each projection is located between the distal surface and the basal surface of an adjacent one of the outer blade pieces. A dimension in a heightwise direction defined by the peak of each projection and the distal surface of the projection is less than or equal to a thickness of each outer blade piece defined by the distal surface and the basal surface of the outer blade piece.

In the above slit blade block, the peaks of the projections of the comb teeth may be located close to the skin of a user. This allows the comb teeth to smoothly lift up long whiskers, which are lying on the skin. Thus, the slit blade block can shorten the long whiskers, which are lying on the skin.

Preferably, the outer blade pieces are laid out in a layout direction. The outer blade pieces are respectively aligned with the comb teeth. A width of each comb tooth in the layout direction is less than or equal to a width of each outer blade piece in the layout direction.

Preferably, the comb component includes a projection piece that projects toward the slit outer blade. The slit outer blade includes a fitting portion that is fitted to the projection piece.

Another aspect of the present invention is an electric razor that includes the slit blade block, which has been described above.

EFFECTS OF THE INVENTION

A slit blade block according to the present invention obtains an electric razor that is capable of shortening long whiskers.

EMBODIMENTS OF THE INVENTION

Figure 1:
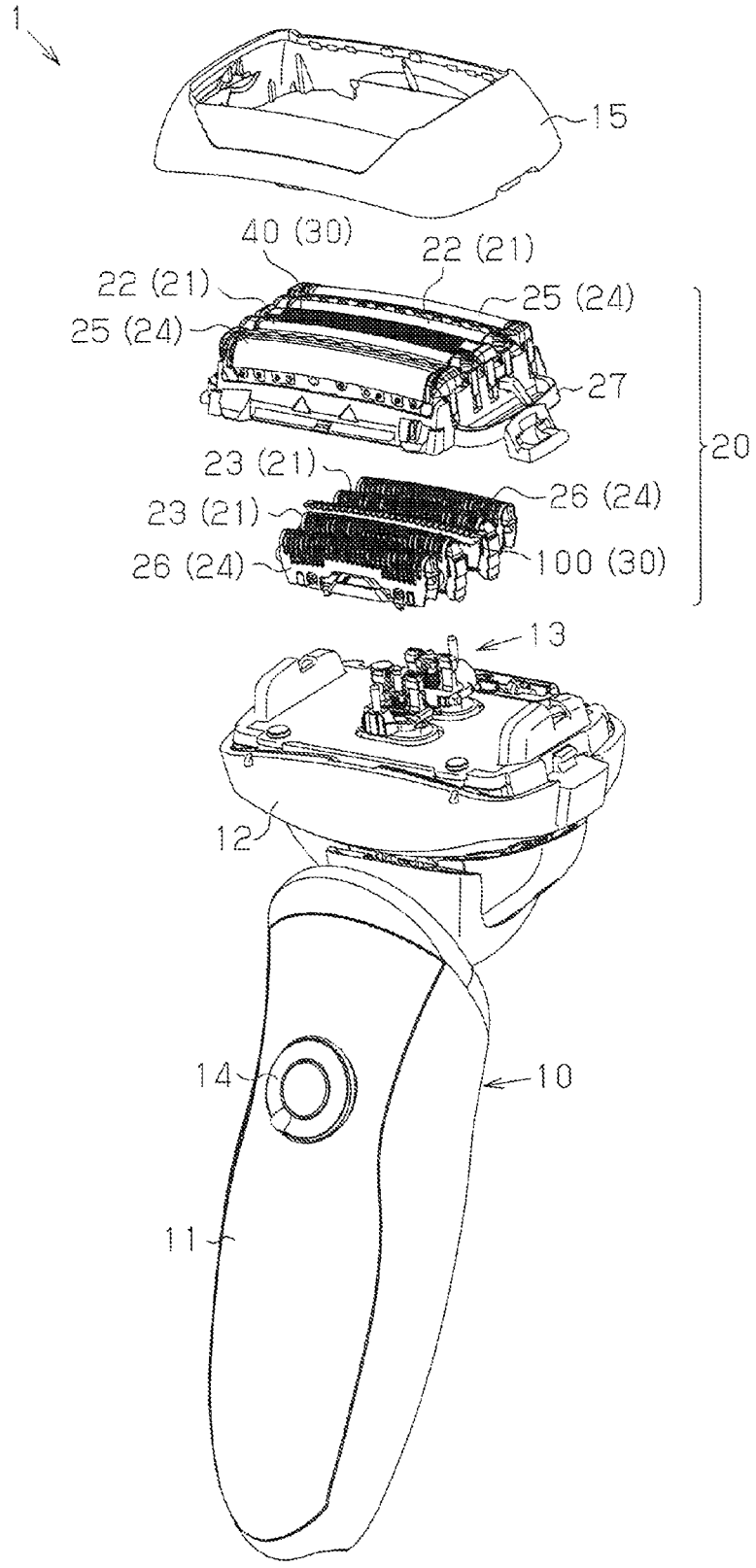
FIG. 1 is an exploded perspective view of one embodiment of an electric razor.

Referring to FIG. 1, an electric razor 1 will now be described.

The electric razor 1 includes a razor body 10 and a blade unit 20. The razor body 10 includes a grip 11, a head 12, a driver 13, a power supply switch 14, and a head cover 15. The head 12 is coupled to the grip 11. The driver 13 is accommodated in the grip 11 and the head 12. The driver 13 is partially exposed from the head 12 to an outer side. The driver 13 oscillates the blade unit 20. The power supply switch 14 is located on the grip 11. The head cover 15 is attached to the head 12.

The head cover 15 covers a periphery portion of the blade unit 20. The blade unit 20 includes two first blade blocks 21, two second blade blocks 24, a slit blade block 30, and an outer blade case 27. The two first blade blocks 21 are locate at opposite sides of the slit blade block 30. Each second blade block 24 and the slit blade block 30 are located at opposite sides of one of the first blade blocks 21. The outer blade case 27 holds the first blade blocks 21, the second blade blocks 24, and the slit blade block 30. The outer blade case 27 is attached to the head 12.

Each first blade block 21 includes a first net blade 22 and a first inner blade 23. Each first net blade 22 accommodates the corresponding first inner blade 23. The driver 13 oscillates the first inner blades 23 relative to the first net blades 22.

Each second blade block 24 includes a second net blade 25 and a second inner blade 26. Each second net blade 25 accommodates the corresponding second inner blade 26. The driver 13 oscillates the second inner blades 26 relative to the second net blades 25. In this manner, the electric razor 1 may be an oscillation-type electric razor that oscillates the inner blades 23, 26 relative to the net blades 22, 25.

The blade unit 20 will now be described.

The first blade blocks 21 function to mainly remove lying whiskers (hair). The second blade blocks 24 function to mainly remove short standing whiskers (hair). The slit blade block 30 functions to mainly remove long whiskers (hair).

The slit blade block 30 will now be described with reference to FIG. 2. In the description hereafter, upper and lower positions are defined with reference to the position of the electric razor 1 shown in FIG. 1.

The slit blade block 30 includes a slit outer blade 40, a comb component 60, two outer blade connectors 90, a slit inner blade 100, an inner blade connector 110, and two coil springs 31. The slit blade block 30 is connected to the driver 13 (refer to FIG. 1) by the inner blade connector 110.

The slit outer blade 40 is formed by a metallic material. The slit outer blade 40 may be formed, for example, by pressing. The slit outer blade 40 includes an upper plane virtually connecting upper surfaces of outer blade pieces 41. The upper plane is bulged upward. The slit outer blade 40 includes a lower opening that receives the slit inner blade 100. The slit outer blade 40 includes the outer blade pieces 41, slits 42, two links 43, and two slit bodies 50. The slit outer blade 40 may be a single component entirely formed from the same material. The outer blade pieces 41 are laid out in a layout direction, which is indicated by the arrow ZA. The layout direction ZA may be a direction in which the slit inner blade 100 moves, a longitudinal direction of the slit blade block 30, and a widthwise direction of the electric razor 1.

The comb component 60 is a component differing from the slit outer blade 40. The comb component 60 is formed from a resin material. The comb component 60 may be, for example, injection-molded. The comb component 60 includes an upper opening 61 that receives the slit outer blade 40. In the illustrated example, the comb component 60 is frame-shaped as viewed from above. In an example, the comb component 60 is slightly bulged upward. The rigidity of the comb component 60 is lower than the rigidity of the slit outer blade 40. The comb component 60 includes two comb walls 70 and two comb end walls 80. The comb component 60 may be a single component entirely formed from the same material.

Each outer blade connector 90 is formed from a resin material. Each outer blade connector 90 may be, for example, injection-molded. Each outer blade connector 90 includes a connector body 91, a seat 92, a projection 93, an accommodation hole 94, two first welding portions 95, fair two second welding portions 96, and a spring attachment 97. The projection 93 and the accommodation hole 94 may be part of the seat 92. The outer blade connector 90 may be a single component entirely formed from the same material.

The slit inner blade 100 is formed from a metallic material. The slit inner blade 100 may be formed, for example, by pressing. The slit inner blade 100 includes two slit bodies 101, inner blade pieces 102, and slits 103. The slit inner blade 100 may be a single component entirely formed from the same material.

Each slit body 101 includes two positioning portions 104 and two weld fixing portions 105. The slit bodies 101 are connected to each other by the inner blade pieces 102. Each positioning portion 104 may be a recess that opens downward. Each weld fixing portion 105 may include two arms extending downward. In the illustrated example, each weld fixing portion 105 is located between one of the positioning portions 104 and the middle, in the widthwise direction ZA, of the corresponding slit body 101.

The inner blade pieces 102 are arranged at predetermined pitches, which correspond to the slits 103. Each inner blade piece 102 is, for example, U-shaped.

The inner blade connector 110 is formed from a resin material. The inner blade connector 110 may be, for example, injection-molded. The inner blade connector 110 includes a connector body 111, a drive fitting portion 112, four positioning portions 113, four welding portions 114, and two spring attachments 115. The inner blade connector 110 may be a single component entirely formed from the same material.

The drive fitting portion 112 is fitted to the driver 13 (refer to FIG. 1). The drive fitting portion 112 is located in the middle, in the widthwise direction ZA, of the connector body 111. The positioning portions 113 are located between the drive fitting portion 112 and ends, in the widthwise direction ZA, of the connector body 111. The positioning portions 113 project from outer surfaces of the connector body 111 in the depth direction ZB. The welding portions 114 are located proximate to the middle, in the widthwise direction ZA, of the connector body 111. The welding portions 114 project from the outer surfaces of the connector body 111 in the depth direction ZB. The spring attachments 115 are located at the ends, in the widthwise direction ZA, of the connector body 111 and project downward.

The slit outer blade 40 will now be described with reference to FIG. 2.

The outer blade pieces 41 are arranged between the links 43 at predetermined pitches, which correspond to the slits 42. Each outer blade piece 41 is, for example, U-shaped. Each slit 42 extends in the depth direction ZB. Whiskers (hair) are guided into the slits 42.

Figures 7A, 7B, 7C:
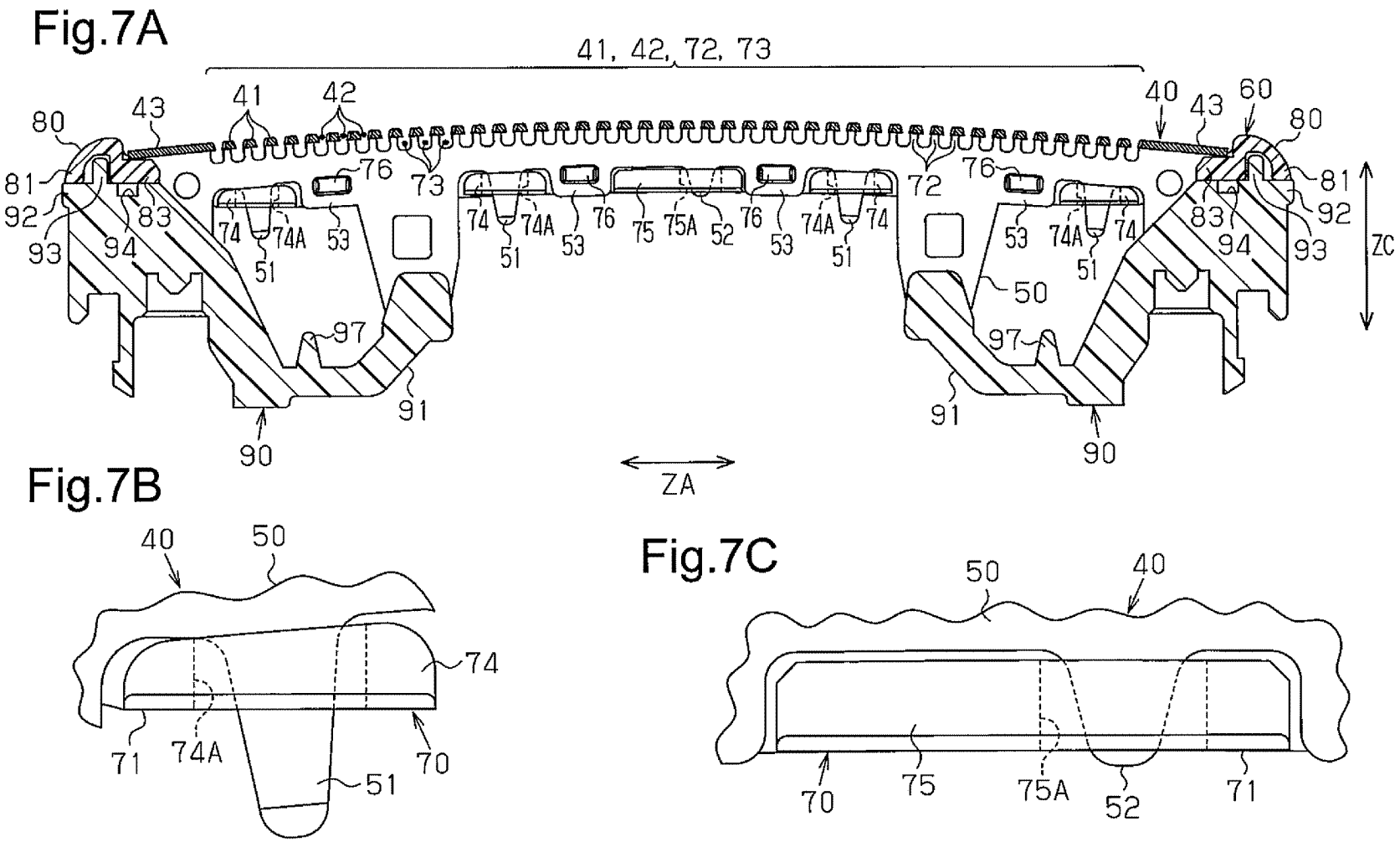
FIG. 7A is a cross-sectional view of the slit blade block taken along line Z6A-Z6A of FIG. 6A.
FIG. 7B is an enlarged view of a first claw piece and a first socket.
FIG. 7C is an enlarged view of a second claw piece and a second socket.

The links 43 are located at two opposite ends, in the widthwise direction ZA, of the slit outer blade 40. As shown in FIG. 7A, the links 43 are plate-like and slightly inclined so that the links 43 are sloped upward toward the middle, in the widthwise direction ZA, of the slit outer blade 40.

Each slit body 50 is formed by a wall that is parallel in the widthwise direction ZA and the heightwise direction ZC.

Each slit body 50 includes four first claws 51, one second claw 52, four fitting portions 53, two first weld fixing portions 54, and two second weld fixing portions 55. The slit bodies 50 are connected to each other by the outer blade pieces 41 and the links 43.

The first weld fixing portions 54 are located at the ends, in the widthwise direction ZA, of each slit body 50. Each second weld fixing portion 55 is located between one of the first weld fixing portions 54 and the middle, in the widthwise direction ZA, of the corresponding slit body 50.

Each first claw 51 is tapered so that the size in the widthwise direction ZA decreases toward the lower end. The lower end surface of each first claw 51 is, for example, curved. The first claws 51 are separated from one another. For example, some of the first claws 51 are located between a first weld fixing portion 54 and a second weld fixing portion 55. The other first claws 51 are arranged between the second weld fixing portions 55.

Each second claw 52 is tapered so that the size in the widthwise direction ZA decreases toward the lower end. The lower end surface of each second claw 52 is, for example, curved. Each second claw 52 is located in the middle, in the widthwise direction ZA, of the corresponding slit body 50. The second claws 52 are shorter than the first claws 51.

The fitting portions 53 are separated from one another in the widthwise direction ZA. For example, some of the fitting portions 53 are adjacent to the outer edge, in the widthwise direction ZA, of a second weld fixing portion 55. The other fitting portions 53 are located between a first claw 51 and a second claw 52. Each fitting portion 53 includes a through hole 53A extending in the depth direction ZB through the corresponding slit body 50.

The outer blade connectors 90 will now be described with reference to FIG. 2.

Each seat 92 includes an upper surface, which may be flat. The upper surface of each seat 92 is, for example, T-shaped. Each seat 92 is located at the outer, in the widthwise direction ZA, and upper end of the corresponding connector body 91. Each seat 92 includes an outer seat 92A and an inner seat 92B. The upper surface of the outer seat 92A is flush with the upper surface of the inner seat 92B. The outer seat 92A is greater than the inner seat 92B in the size in the depth direction ZB.

Each projection 93 may be rectangular the size of which is greater in the depth direction ZB than in the widthwise direction ZA. Each projection 93 projects upward from the corresponding outer seat 92A.

Each inner seat 92B includes an accommodation hole 94. Each accommodation hole 94 is adjacent to the corresponding projection 93 in the widthwise direction ZA. Each accommodation hole 94 extends downward from the upper surface of the corresponding inner seat 92B.

Each first welding portion 95 is tubular. Each first welding portion 95 is located on or proximate to the outer end, in the widthwise direction ZA, of the corresponding the connector body 91. The first welding portions 95 project from outer surfaces of the corresponding connector body 91 in the depth direction ZB.

Each second welding portion 96 is tubular. Each second welding portion 96 is located on the inner end, in the widthwise direction ZA, of the connector body 91. The second welding portions 96 project from the outer surfaces of the corresponding connector body 91 in the depth direction ZB.

Each spring attachment 97 is located between a first welding portions 95 and the corresponding second welding portion 96 in the widthwise direction ZA. Each spring attachment 97 includes a projection projecting upward from the corresponding connector body 91. The projections may each be circular cone-shaped.

The comb component 60 will now be described with reference to FIGS. 3 and 4.

Figure 3:
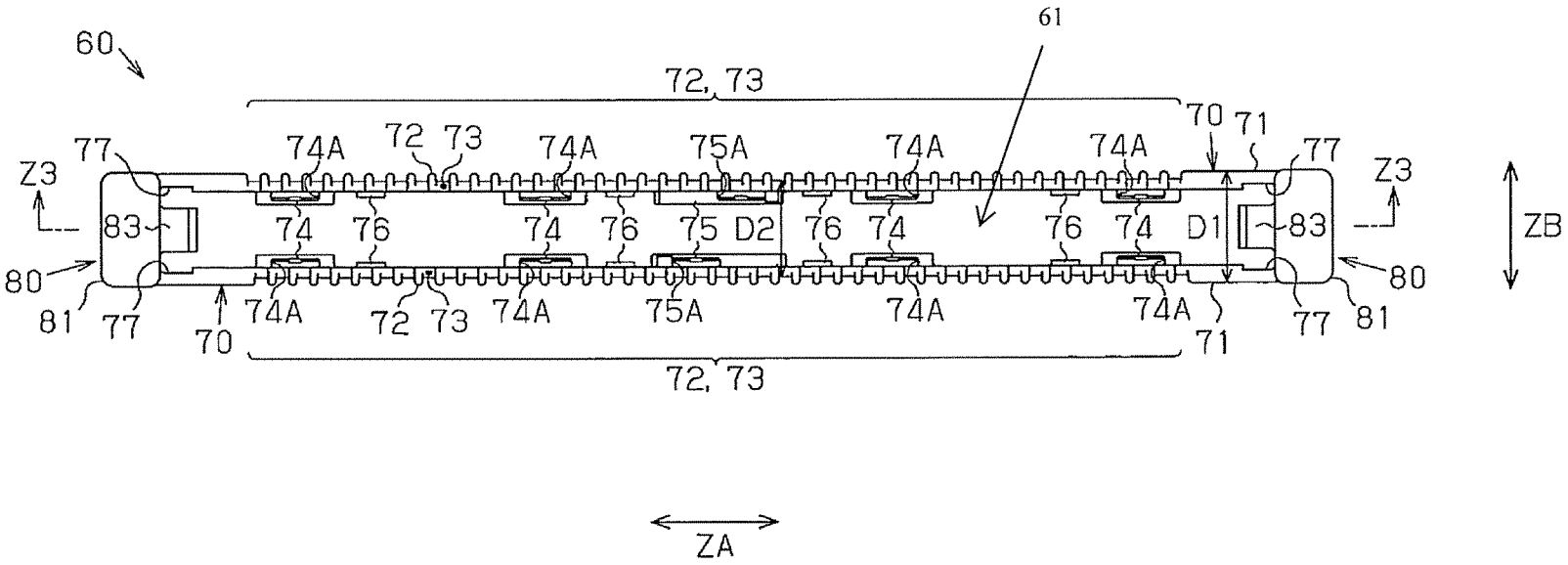
FIG. 3 is a plan view of a comb component of the embodiment.

As shown in FIG. 3, in the comb component 60, the depth distance D1 at the end, in the widthwise direction ZA, of the comb walls 70 is greater than the depth distance D2 at the middle, in the widthwise direction ZA, of the comb walls 70.

Each comb wall 70 includes a comb wall body 71, comb teeth 72, slits 73, four first sockets 74, one second socket 75, four positioning portions 76, and two recesses 77. Each comb wall 70 is a single element entirely formed from the same material.

Each comb wall body 71 extends in the widthwise direction ZA and is slightly curved upward. The comb teeth 72 are located on an upper portion of each comb wall body 71. The comb teeth 72 are arranged in the widthwise direction ZA at predetermined pitches, which correspond to the slits 73. The slits 73 guide long whiskers (hair) together with the slits 42 of the slit outer blade 40 (refer to FIG. 2). In the illustrated example, the comb teeth 72 each project outward from the corresponding comb wall body 71.

Figure 4A:
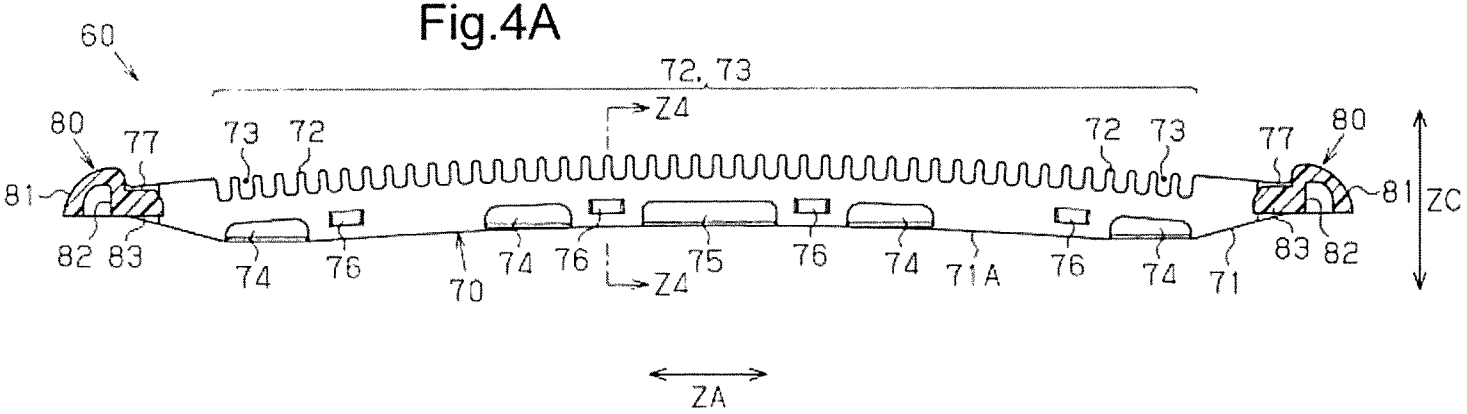
FIG. 4A is a cross-sectional view of the comb component taken along line Z3-Z3 of FIG. 3.
Figure 4B:
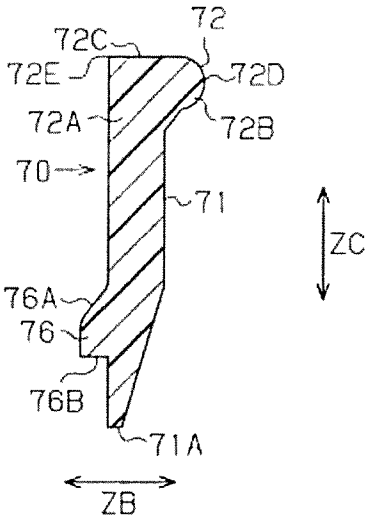
FIG. 4B is a cross-sectional view of the comb component taken along line Z4-Z4 of FIG. 4A.

As shown in FIG. 4B, each comb tooth 72 includes a base 72A and a tip 72B. Each comb tooth 72 is a single element entirely formed from the same material. The base 72A is rod-shaped and extends in the heightwise direction ZC. The tip 72B includes a distal surface, which is curved or hemispherical. The tip 72B projects outward in the depth direction ZB from an upper portion of the base 72A. Each comb wall body 71 functions to guide long whiskers (hair) to the slits 42 of the slit outer blade 40.

As shown in FIG. 3, the first sockets 74 are separated from one another in the widthwise direction ZA. Each first socket 74 projects from the inner surface of the corresponding comb wall body 71. Each first socket 74 includes a through hole 74A extending in the heightwise direction ZC. The first sockets 74 include two outermost first sockets 74, which are located at positions corresponding to two opposite ends of the row of the comb teeth 72.

Each second socket 75 is located at the middle, in the widthwise direction ZA, of the corresponding comb wall body 71. Each second socket 75 projects from the inner surface of the corresponding comb wall body 71. Each second socket 75 includes a through hole 75A extending in the heightwise direction ZC. The second sockets 75 are greater than the first sockets 74 in the size in the widthwise direction ZA.

The recesses 77 are located at two opposite ends, in the widthwise direction ZA, of each comb wall body 71. Each recess 77 is adjacent to the corresponding comb end wall 80. Each recess 77 forms a step between the inner surface of the corresponding comb wall body 71 and the corresponding comb end wall 80.

The positioning portions 76 are separated from one another in the widthwise direction ZA. The positioning portions 76 are located proximate to the first sockets 74. In the illustrated example, locations between two adjacent first sockets 74 each include a positioning portion 76. Also, locations between a first socket 74 and a second socket 75 each include a positioning portion 76. Each positioning portion 76 may be a projection piece projecting from the inner surface of the corresponding comb wall body 71.

As shown in FIG. 4B, each positioning portion 76 includes an inclined surface 76A and a stopper surface 76B. The inclined surface 76A and the stopper surface 76B are located at opposite sides in the heightwise direction ZC. The stopper surface 76B may be a lower end surface of the positioning portion 76. The stopper surface 76B may be flat and parallel in the widthwise direction ZA and the depth direction ZB.

As shown in FIG. 4A, each comb end wall 80 includes an end wall body 81, a socket 82, and a projection 83. Each comb end wall 80 is a single element entirely formed from the same material. The end wall body 81 of each comb end wall 80 is connected to an end, in the widthwise direction ZA, of the corresponding comb wall body 71.

Each end wall body 81 may include a surface that is smoothly curved upward. The uppermost end of each end wall body 81 is located above the comb wall bodies 71.

Each socket 82 may be a recess formed in a lower surface of the corresponding end wall body 81 and extending upward.

Each projection 83 is located in the upper opening of the comb component 60. Each projection 83 is located below an upper end of the corresponding end wall body 81 and projects toward the middle of the comb component 60. In the illustrated example, each projection 83 includes a flat upper surface, which is parallel in the width direction ZA and the depth direction ZB, and side surfaces, which are opposed to the corresponding recesses 77 of the comb walls 70 (refer to FIG. 3). The upper surface of each projection 83 may be, for example, tetragonal (refer to FIG. 3). When injection-molding the comb component 60, the gate of a mold, into which a molding material flows, is located at a lower surface 83A of a projection 83.

The slit blade block 30 will now be described with reference to FIGS. 5 and 6.

Figure 5:
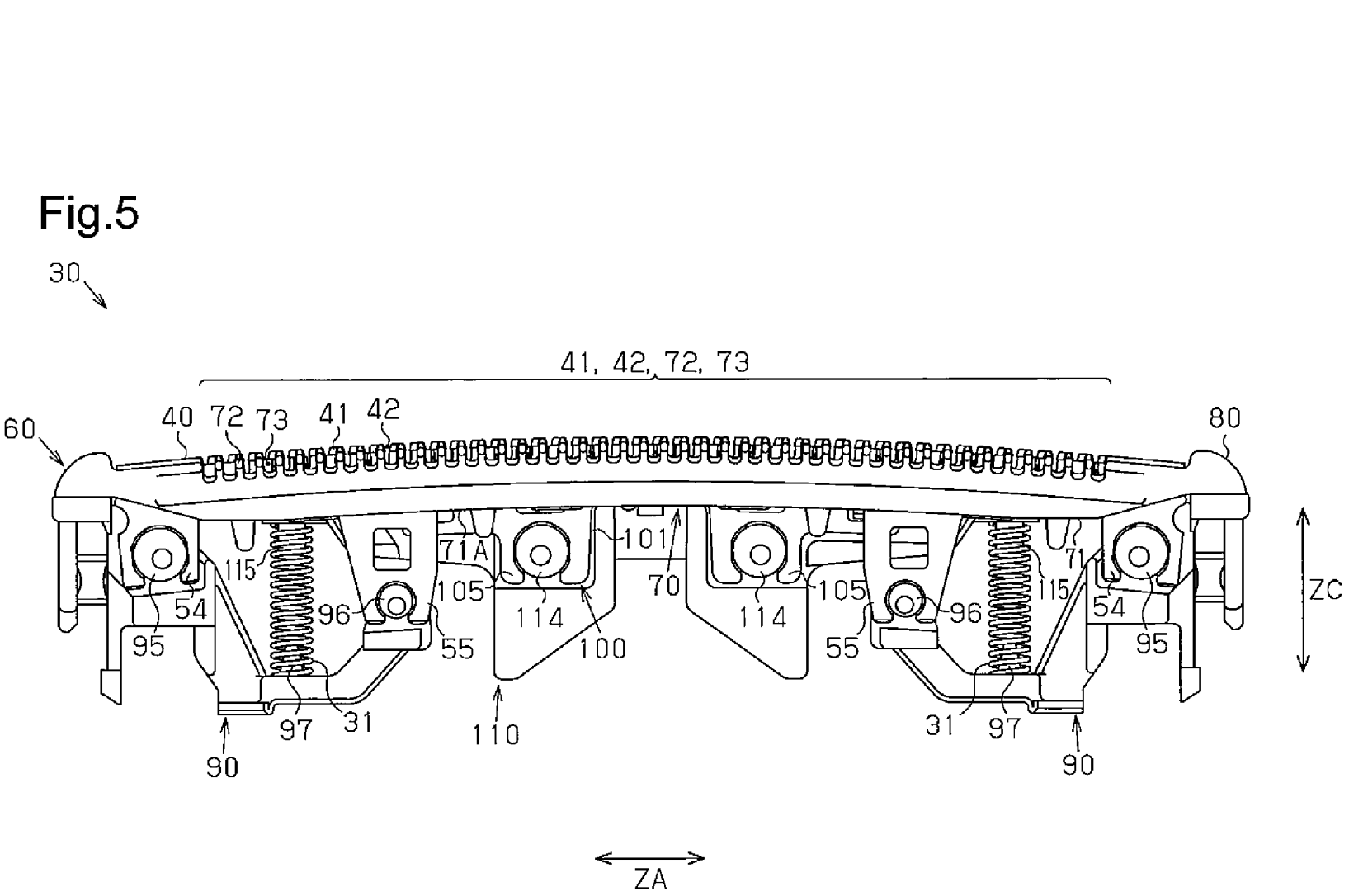
FIG. 5 is a front view of the slit blade block.

As shown in FIG. 5, in the slit blade block 30, the slit outer blade 40, the comb component 60, the outer blade connectors 90, the slit inner blade 100, the inner blade connector 110, and the coil springs 31 are coupled together.

In this situation, the weld fixing portions 54, 55 of the slit outer blade 40 and the welding portions 95, 96 of the outer blade connectors 90 each project downward beyond lower surfaces 71A of the comb wall bodies 71 of the comb walls 70. Additionally, the weld fixing portions 105 of the slit inner blade 100 and the welding portions 114 of the inner blade connector 110 project downward beyond the lower surfaces 71A of the comb wall bodies 71.

The first weld fixing portions 54 of the slit outer blade 40 engage the first welding portions 95 of the outer blade connectors 90. The first welding portions 95 are welded to the first weld fixing portions 54 by heat sealing. This fixes the slit outer blade 40 to the outer blade connectors 90. The second welding portions 96 of the outer blade connectors 90 engage the second weld fixing portions 55 of the slit outer blade 40. The second welding portions 96 are welded to the second weld fixing portions 55 by heat sealing. This fixes the slit outer blade 40 to the outer blade connectors 90.

The inner blade connector 110 is accommodated between the two slit bodies 101 of the slit inner blade 100. When the positioning portions 113 (refer to FIG. 2) are in contact with the positioning portions 104 of the slit inner blade 100 (refer to FIG. 2), the inner blade connector 110 is positioned relative to the slit inner blade 100. The welding portions 114 of the inner blade connector 110 are welded to the weld fixing portions 105 by heat sealing.

The slit inner blade 100 is accommodated in the slit outer blade 40. The inner blade pieces 102 are located in the same position as the outer blade pieces 41 in the widthwise direction ZA and the depth direction ZB. The inner blade pieces 102 are located below the outer blade pieces 41.

In the slit blade block 30, the coil springs 31 connect the inner blade connector 110 and the outer blade connectors 90. The upper portions of the coil springs 31 are attached to the spring attachments 115 of the inner blade connector 110. The lower portions of the coil springs 31 are attached to the spring attachments 97 of the outer blade connectors 90. The coil springs 31 are continuously compressed by the inner blade connector 110 and the outer blade connectors 90.

Figure 6A:
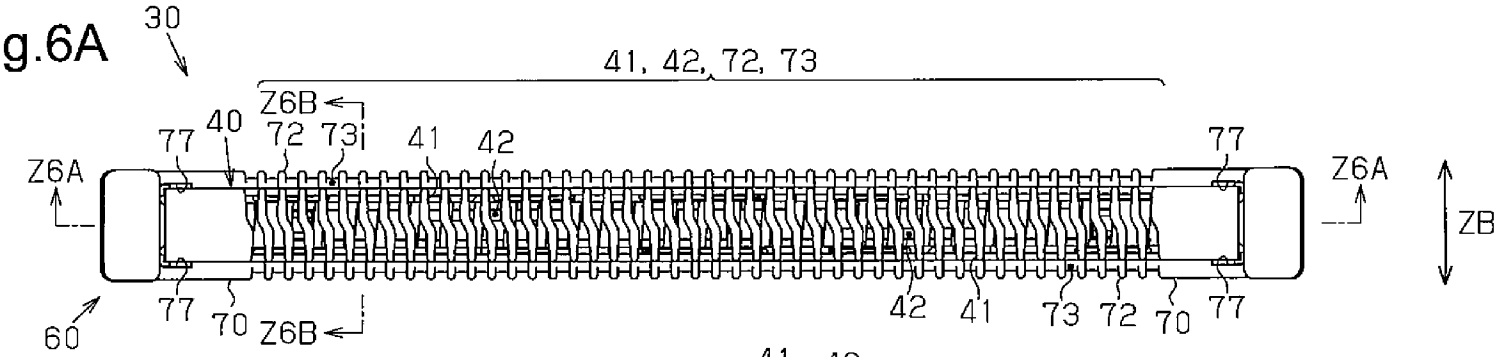
FIG. 6A is a plan view of the slit blade block.

As shown in FIG. 6A, the comb component 60 surrounds the slit outer blade 40. The comb teeth 72 are adjacent to the outer blade pieces 41 in the depth direction ZB. The pitch of the comb teeth 72 is the same as the pitch of the outer blade pieces 41. The comb teeth 72 are aligned with the outer blade pieces 41. The slits 73 of the comb component 60 are in communication with the slits 42 of the slit outer blade 40.

Figure 2:
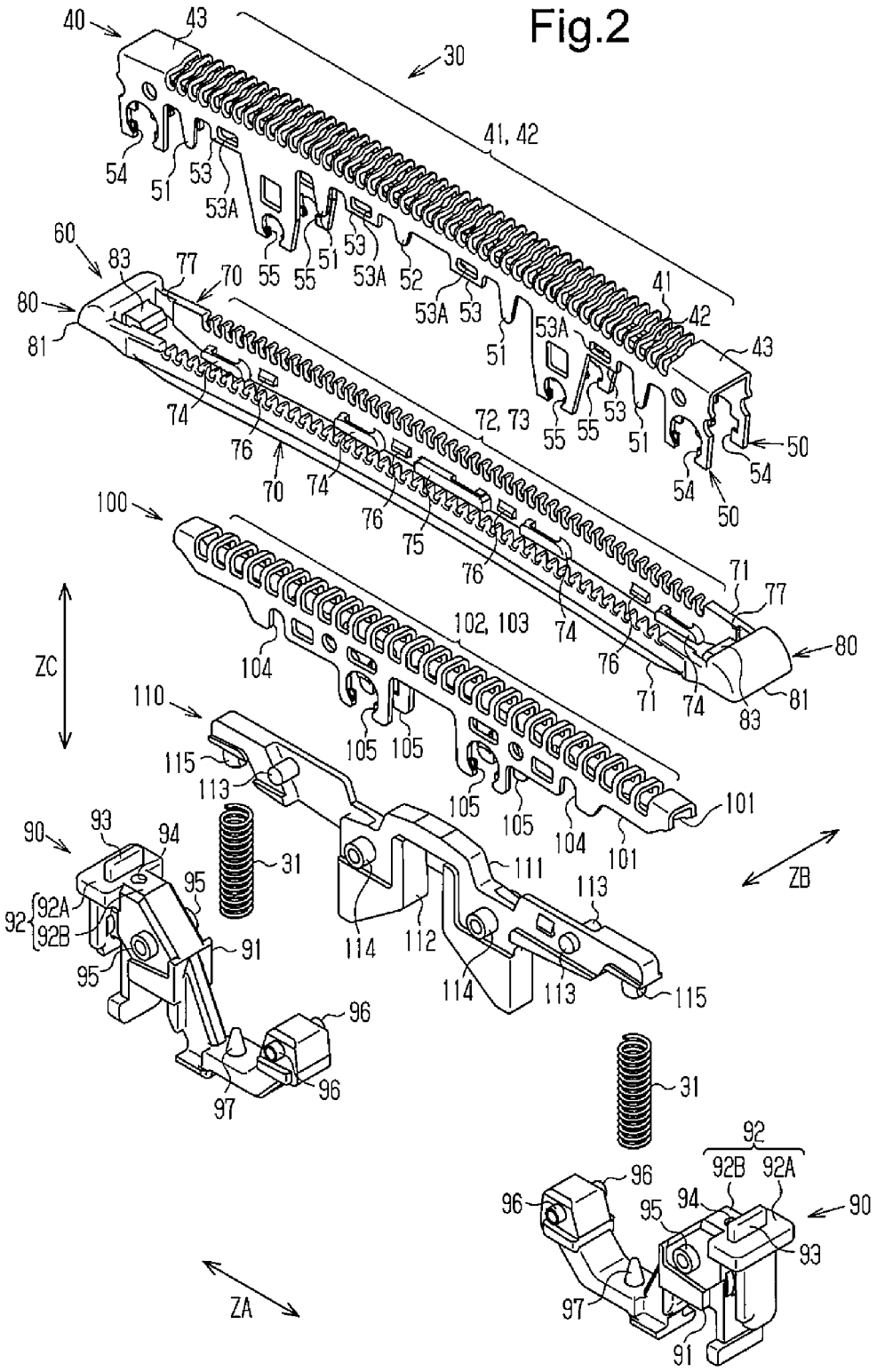
FIG. 2 is an exploded perspective view of a slit blade block of the embodiment.

The entire, in the widthwise direction ZA, of the comb walls 70 is opposed, in the depth direction ZB, to the slit bodies 50 of the slit outer blade 40 (refer to FIG. 2). The recesses 77 of each comb wall 70 are opposed to a surface, in the depth direction ZB, of the corresponding slit body 50 of the slit outer blade 40 with gaps located in between.

Figure 6B:
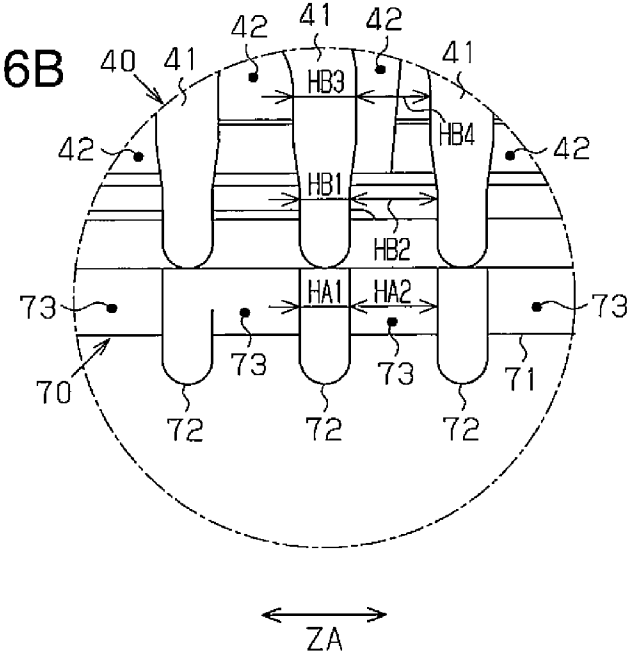
FIG. 6B is a partially enlarged view of FIG. 6A.

FIG. 6B is a plan view of the slit blade block 30. Each comb tooth 72 has a width HA1 in the widthwise direction ZA. Each outer blade piece 41 includes an outer portion that is adjacent to the corresponding comb tooth 72. The outer portion of each outer blade piece 41 has a width HB1 in the widthwise direction ZA. The width HA1 of each comb tooth 72 is the same as the width HB1 of the outer portion of each outer blade piece 41. In the same manner, in a plan view of the slit blade block 30, the width HA2 of a slit 73 of the comb component 60 is the same as the width HB2, at a location proximate to the comb teeth 72, of a slit 42 of the slit outer blade 42.

As shown in FIG. 6A, each outer blade piece 41 may have a varying width. In a plan view of the slit blade block 30, each outer blade piece 41 may include the outer portion or a relatively narrow portion (width HB1), which is adjacent to the corresponding comb tooth 72, and a central portion or a relatively wide portion (width HB3), which is offset from the relatively narrow portion in the depth direction ZB. The width HB3 of the central portion of each outer blade piece 41 is greater than the width HA1 of the adjacent comb tooth 72. The width HB4, at the central portion, of a slit 42 is smaller than the width HA2 of a slit 73.

As shown in FIG. 7A, the links 43 of the slit outer blade 40 are located on upper surfaces of the projections 83 of the comb end walls 80. The end wall body 81 of each comb end wall 80 includes a lower surface that is in contact with an upper surface of the seat 92 of the corresponding outer blade connector 90. The projection 83 of each comb end wall 80 includes a lower surface that is in contact with the upper surface of the seat 92. Each accommodation hole 94 accommodates a portion of the comb component 60 that is cut away from a mold gate.

In the illustrated example, each link 43 of the slit outer blade 40 is separated in the widthwise direction ZA from the corresponding comb end wall 80 of the comb component 60 with a slight gap located in between. The projections 93 of the outer blade connectors 90 are accommodated in the sockets 82 of the comb component 60.

In this manner, the projections 83 of the comb component 60 are held between the slit outer blade 40 and the outer blade connectors 90 in the heightwise direction ZC and the widthwise direction ZA. This prevents or limits movement of the comb component 60 relative to the slit outer blade 40 and the outer blade connectors 90 in the heightwise direction ZC and the widthwise direction ZA.

As shown in FIG. 7B, the first claw 51 of the slit outer blade 40 is inserted into the through hole 74A of the first socket 74. As shown in FIG. 7C, the second claw 52 of the slit outer blade 40 is inserted into the through hole 75A of the second socket 75.

As shown in FIG. 7A, the fitting portions 53 of the slit outer blade 40 are fitted to the positioning portions 76 of the comb component 60. In an example shown in FIG. 8, when the positioning portions 76 are fitted into the fitting portions 53, each stopper surface 76B is separated upward from an inner surface of the corresponding through hole 53A with a slight gap located in between. The inclined surface 76A of each positioning portion 76 is accommodated in the corresponding fitting portion 53.

Figure 8:
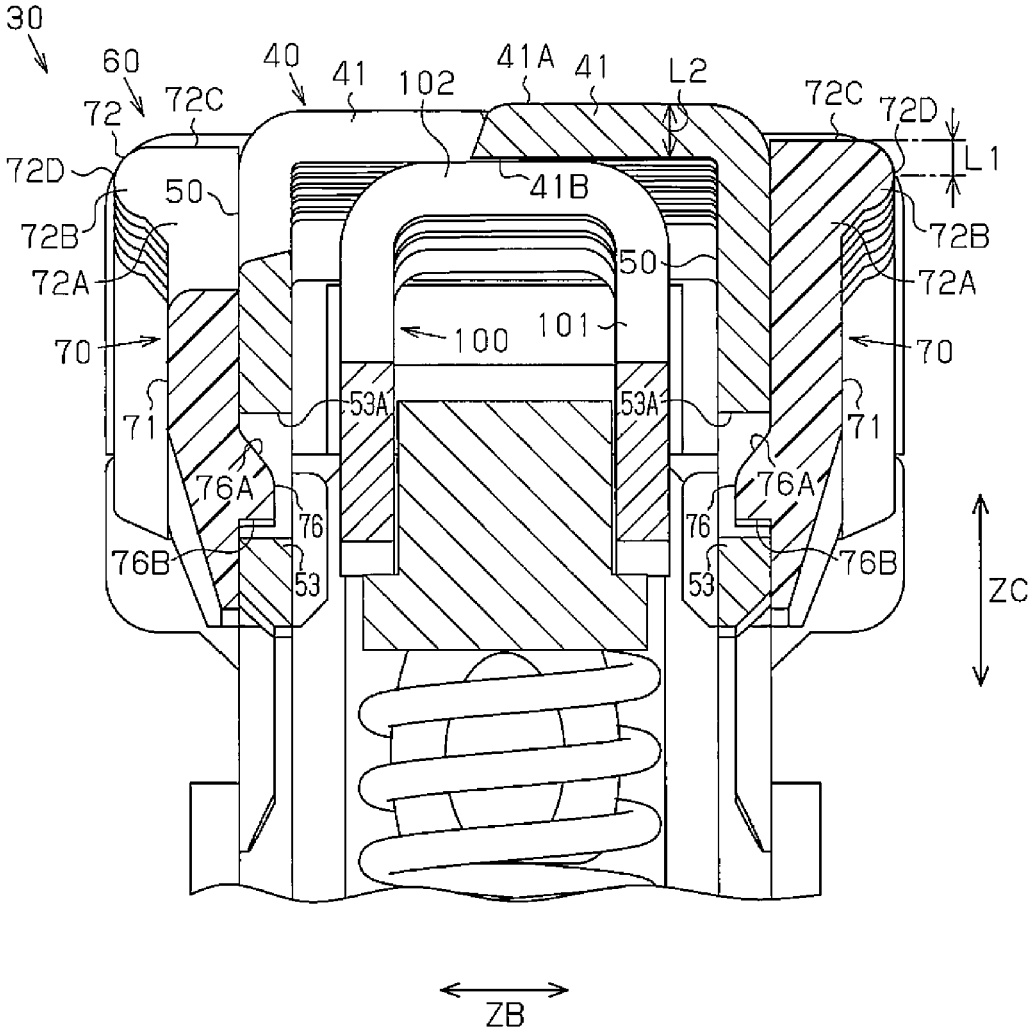
FIG. 8 is a cross-sectional view of the slit blade block taken along line Z6B-Z6B of FIG. 6.

Referring to FIG. 8, positions of the outer blade pieces 41 and the comb teeth 72 will now be described. Each outer blade piece 41 includes a lower surface 41B (basal surface), which is opposed to the slit inner blade 100, and an upper surface 41A (distal surface), which is located at a side opposite to the basal surface 41B. Each comb tooth 72 includes an upper surface 72C (distal surface) and a projection 72B projecting outward in the depth direction ZB, that is, a direction parting from the outer blade pieces 41. Each projection 72B includes a peak 72D, which is the outermost end in the depth direction ZB. The distal surface 72C of each comb tooth 72 is the uppermost surface of the projection 72B. For example, the distal surface 72C of each comb tooth 72 is flat and extends in the depth direction ZB. The distal surface 72C of each comb tooth 72 is located above the lower surface 41B of the corresponding outer blade piece 41 and below the upper surface 41A of the outer blade piece 41.

The peak 72D of the projection 72B of each comb tooth 72 is located slightly below the lower surface 41B of the corresponding outer blade piece 41. The dimension L1, which is defined by the distal surface 72C of a comb tooth 72 and the peak 72D of the projection 72B in the heightwise direction ZC, is smaller than the thickness L2 of an outer blade piece 41, which is defined by the upper surface 41A and the lower surface 41B of the corresponding outer blade piece 41.

The function of the comb teeth 72 when whiskers are shaved with the electric razor 1 will now be described with reference to FIG. 9.

Figure 9A:
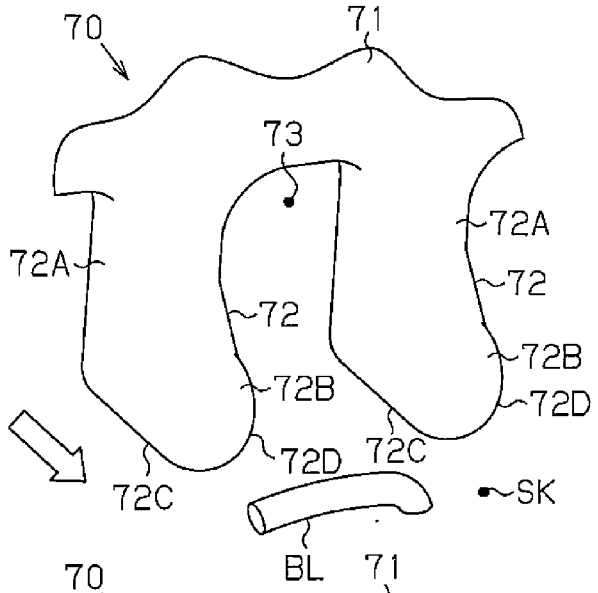
FIG. 9 includes perspective views of comb teeth.
Figure 9B:
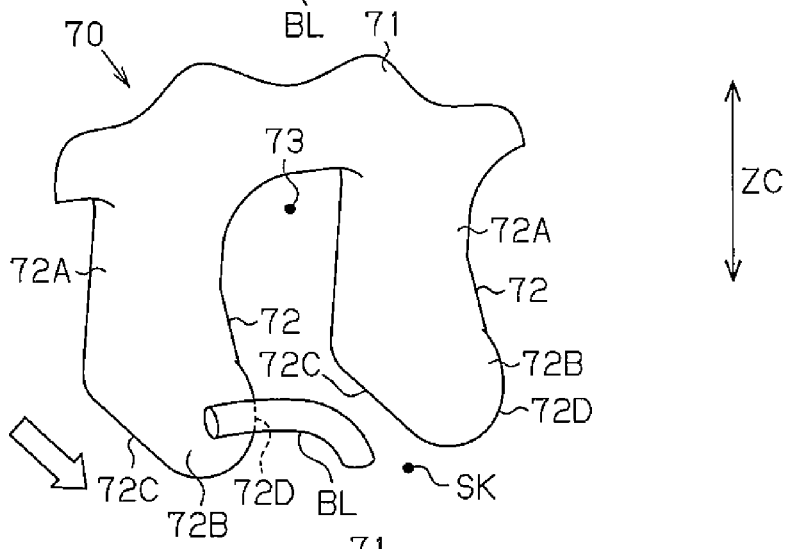
Figure 9C:
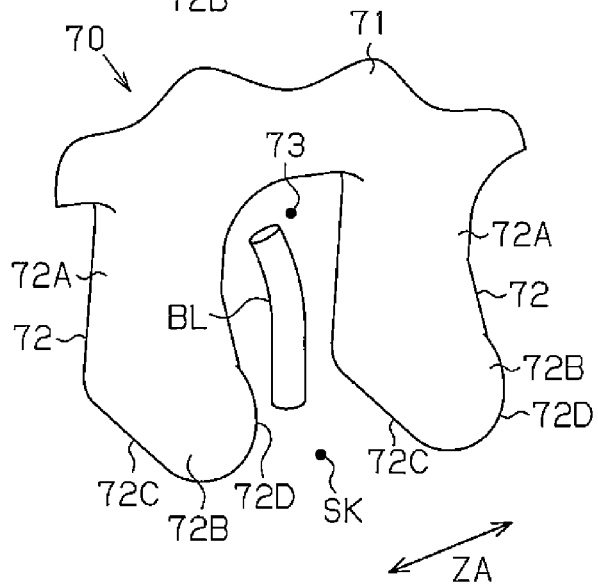

FIG. 9A shows a long whisker BL lying on the skin SK. As shown in FIG. 9B, when the peak 72D of a comb tooth 72 enters between the skin SK and the long whisker BL, the long whisker BL is lifted onto the peak 72D. When the comb tooth 72 is moved further, the long whisker BL is moved along the surface of the comb tooth 72 and lifted. Then, as shown in FIG. 9C, the lifted long whisker BL is guided into the slit 73.

The operation of the electric razor 1 will now be described with reference to FIGS. 10 and 11.

Figure 11:
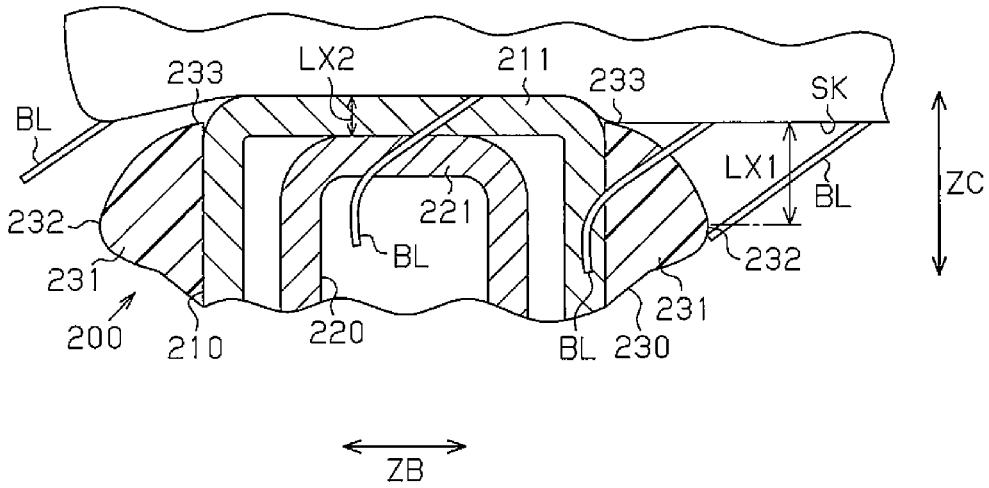
FIG. 11 is a schematic cross-sectional view of a comparative example of a slit blade block.
Figure 12:
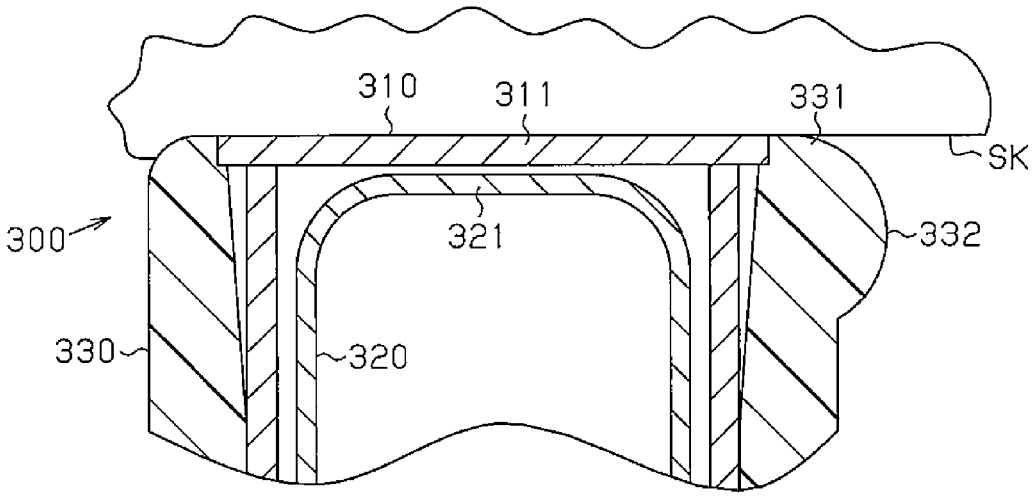
FIG. 12 is a partial cross-sectional view of a conventional slit blade block.

FIG. 11 illustrates a reference example of a slit blade block 200. The slit blade block 200 of the reference example includes a comb component 230 having comb teeth 231. The shape of the comb teeth 231 differs from that of the comb teeth 72 of the embodiment. The shapes of a slit outer blade 210 and a slit inner blade 220 are the same as those of the embodiment.

Each comb tooth 231 includes a peak 232, which is located below the lower surface of an inner blade piece 221 of the slit inner blade 220. The dimension LX1, which is defined by the peak 232 and an upper end 233 of the comb component 230 in the heightwise direction ZC, is greater than the thickness LX2 of a corresponding outer blade piece 211 of the slit outer blade 210.

Thus, when an electric razor having the slit blade block 200 of the reference example is used, the comb tooth 231 contacts distal portions of long whiskers BL lying on the skin SK of the user and lifts only the distal portions of the long whiskers BL. The basal portions of the long whiskers BL remain lying. The long whiskers BL are guided through slits (not shown) of the comb teeth 231 to the slit outer blade 210. The outer blade pieces 211 and the inner blade pieces 221 cut the long whiskers BL, the basal portions of which are lying. As shown at the left end of FIG. 11, the long whisker BL, which has been cut, is relatively long.

Figure 10:
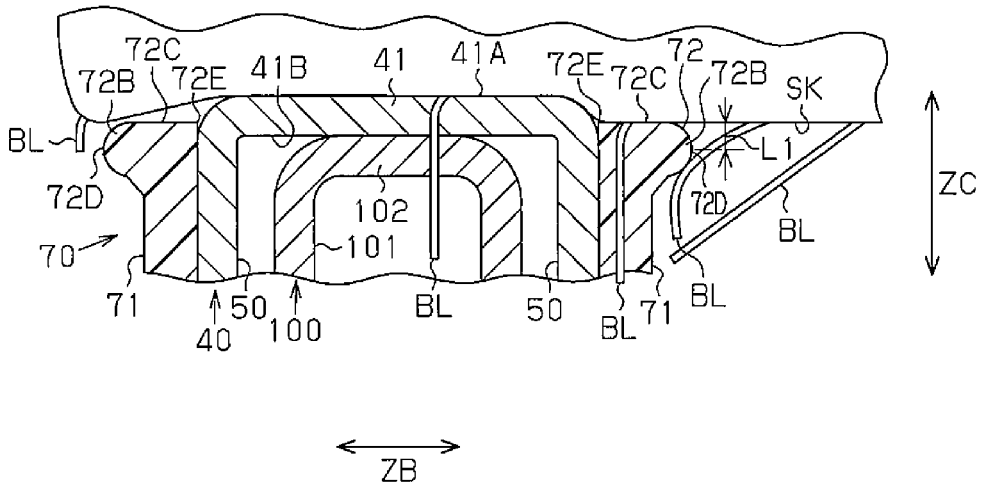
FIG. 10 is a schematic cross-sectional view of the slit blade block of the embodiment.

However, as shown in FIG. 10, in the slit blade block 30 of the embodiment, the dimension L1 of the peak 72D of the comb tooth 72 is smaller than the dimension LX1 of the reference example of FIG. 11. Additionally, in the slit blade block 30, the distal surface 72C of the comb tooth 72 is located above the lower surface 41B of the outer blade piece 41. Thus, the peak 72D of the comb tooth 72 of the comb component 60 may be located closer to the skin SK than the peak 232 of the comb tooth 231 of the reference example. When the electric razor having the slit blade block 30 of the embodiment is used, the comb teeth 72 contact basal portions of long whiskers BL and lift the basal portions of the long whiskers BL. The long whiskers BL are guided to the slit outer blade 40 through the slits 73 (refer to FIG. 3) of the comb teeth 72. The long whiskers BL, the basal portions of which are lifted, are cut by the outer blade pieces 41 and the inner blade pieces 102. As shown at the left end of FIG. 10, the long whisker BL, which has been cut, is relatively short. Then, the long whisker BL, which has been cut by the slit blade block 30 and remains lifted, is smoothly guided to the first net blade 22 (refer to FIG. 1).

The thickness L2 of the outer blade pieces 41 is set to be large enough to prevent or limit the entry of the skin SK between the outer blade pieces 41 and the inner blade pieces 102 when the electric razor 1 is used. Thus, the skin SK is never located below the lower surfaces 41B of the outer blade pieces 41. If the distal surfaces of the comb teeth are located below the lower surfaces of the comb outer blade pieces, the comb teeth would be separated from the skin SK when the electric razor 1 is used. Thus, it is difficult for the comb teeth to lift long whiskers BL lying on the skin SK.

However, in the slit blade block 30 of the embodiment, the distal surfaces 72C of the comb teeth 72 are located above the lower surfaces 41B. Thus, when the electric razor 1 is used, the distal surfaces 72C of the comb teeth 72 may contact the skin SK. This allows the comb teeth 72 to lift the long whiskers BL lying on the skin SK.

The upper portion of each comb tooth 72 may include a corner 72E at a side opposite to the peak 72D (refer to FIG. 4B). The distal surface 72C of the comb tooth 72 is located below the upper surface 41A of the outer blade piece 41 of the slit outer blade 40. This prevents or limits contact of the skin SK with the corners 72E of the upper portions of the comb teeth 72 when the electric razor 1 is used. This improves the feel when the electric razor 1 contacts the skin SK.

Additionally, as shown in FIG. 7, the dimension in the heightwise direction ZC of the comb component 60 is smaller than the dimension in the heightwise direction ZC of the weld fixing portions 54, 55 of the slit outer blade 40. Thus, the rigidity of the comb component 60 is relatively low. When the electric razor 1 is used, an external force applied to a comb wall 70 through the comb teeth 72 may result in relatively large deformation of the comb wall 70. In this regard, the electric razor 1 of the present embodiment has a structure in which the comb component 60 and the slit outer blade 40 are coupled as follows. More specifically, the first claws 51 of the slit outer blade 40 are accommodated in the first sockets 74 of the comb component 60. The second claws 52 of the slit outer blade 40 are accommodated in the second sockets 75. The fitting portions 53 of the slit outer blade 40 are fitted to the positioning portions 76 of the comb component 60. When a comb wall 70 of the comb component 60 receives an external force directed outward in the depth direction ZB, the first claws 51 contact the first sockets 74. Also, the second claws 52 contact the second sockets 75. This prevents or limits outward deformation, in the depth direction ZB, of the comb wall 70.

The slit blade block 30 includes the first claws 51, which are separated from one another in the widthwise direction ZA, and the first sockets 74, which are separated from one another in the widthwise direction ZA. This prevents or limits outward deformation, in the depth direction ZB, of a comb wall 70 over a wide area of the comb wall 70.

When a comb wall 70 of the comb component 60 receives a downward external force, the stopper surfaces 76B of the comb wall 70 contact the fitting portions 53. This prevents or limits downward deformation of the comb wall 70.

Additionally, the slit blade block 30 includes the fitting portions 53, which are separated in the widthwise direction ZA, and the positioning portions 76, which are separated in the widthwise direction ZA. This prevents or limits downward deformation of a comb wall 70 over a wide area of the comb wall 70.

In this manner, outward deformation of a comb wall 70 is prevented or limited in the depth direction ZB. This prevents or limits outward bending, in the depth direction ZB, of the comb teeth 72, which would be caused by the deformation of the comb wall 70. Thus, when the slit blade block 30 is pressed onto the skin SK, the separation of the peaks 72D of the comb teeth 72 from the skin SK is prevented or limited. This allows the comb teeth 72 to lift long whiskers BL from the basal portions.

Also, prevention or limitation of downward deformation of a comb wall 70 prevents or limits downward movement of the comb teeth 72 resulting from the downward deformation of the comb wall 70. This prevents or limits the separation of comb teeth 72 (e.g., located at the middle in the widthwise direction ZA) from the skin SK, which would be caused by a bent comb wall 70. Thus, the function for lifting the basal portions of the long whiskers BL is not adversely affected in the row of the comb teeth 72.

The electric razor 1 of the present embodiment has the advantages described below.

(1) The distal surfaces 72C of the comb teeth 72 are located above the lower surfaces 41B of the outer blade pieces 41 of the slit outer blade 40 and below the upper surfaces 41A of the outer blade pieces 41. The peaks 72D of the comb teeth 72 are located below the lower surfaces 41B of the outer blade pieces 41. The dimension L1 of the peak 72D of the comb tooth 72 is smaller than the thickness L2 of the outer blade piece 41. In this structure, when the electric razor 1 is used, the peaks 72D of the comb teeth 72 are located close to the skin SK. Long whiskers BL, which are lying on the skin SK, are lifted up by the comb teeth 72 and guided into the slits 73. This allows the electric razor 1 to shorten the long whiskers BL lying on the skin SK. This also prevents or limits deterioration in a skin tactile feeling due to the comb component 60.

(2) The comb teeth 72 are respectively aligned with the outer blade pieces 41 in the widthwise direction ZA. The width HA1 of the comb teeth 72 is the same as the width HB1 of the outer blade pieces 41. In a plan view of the slit blade block 30, the width HA2 of the slits 73 of the comb component 60 is the same as the width HB2 of the slits 42 of the slit outer blade 40. Thus, long whiskers BL, which are lifted by the comb teeth 72, are smoothly guided into the slits 73.

(3) The positioning portions 76 of the comb component 60 are fitted to the fitting portions 53 of the slit outer blade 40. This structure restricts movement of the comb walls 70 relative to the slit outer blade 40 in the heightwise direction ZC. This prevents or limits deformation of the comb walls 70 in the heightwise direction ZC.

(4) The weld fixing portions 54, 55 of the slit outer blade 40 and the welding portions 95, 96 of the outer blade connectors 90 each project downward beyond the comb component 60. This structure facilitates the task for welding the slit outer blade 40 and the outer blade connectors 90. Additionally, the welds of the weld fixing portions 54, 55 and the welding portions 95, 96 may be visually checked.

(5) The comb component 60 includes the first sockets 74, which are fitted to the first claws 51 of the slit outer blade 40. In this structure, when a comb wall 70 receives an outward force in the depth direction ZB, the first claws 51 contact the first sockets 74. This prevents or limits outward deformation of the comb wall 70 in the depth direction ZB.

(6) The comb component 60 includes the second sockets 75, which are fitted to the second claws 52 of the slit outer blade 40. In this structure, when a comb wall 70 receives an outward force in the depth direction ZB, the second claws 52 contact the second sockets 75. This prevents or limits outward deformation of the comb wall 70 in the depth direction ZB.

(7) The weld fixing portions 105 of the slit inner blade 100 and the welding portions 114 of the inner blade connector 110 project downward beyond the lower surfaces 71A of the comb wall bodies 71. This structure facilitates the task for welding the slit inner blade 100 and the inner blade connector 110. Additionally, the welds of the weld fixing portions 105 and the welding portions 114 may be visually checked.

(8) The slit bodies 50 of the slit outer blade 40 are opposed to the comb walls 70 with gaps located in the recesses 77. In this structure, when the slit outer blade 40 is inserted into the comb component 60, a comb wall 70 may be bent outward in the depth direction ZB. In such a case, the recesses 77 prevent or limit interference of two opposite ends, in the widthwise direction ZA, of the comb wall 70 with the links 43 of the slit outer blade 40. Thus, when the slit outer blade 40 is coupled to the comb component 60, the bending of the comb walls 70 is prevented or limited in the depth direction ZB.

The above embodiment may be modified as follows. Modified examples may be combined.

The slit outer blade 40 of the embodiment may exclude at least one of a first claw 51, a second claw 52, and a fitting portion 53.

In the slit outer blade 40 of the embodiment, each slit body 50 includes four first claws 51 and one second claw 52. However, the number of each of the first claws 51 and the second claws 52 is not limited to that illustrated in the embodiment. In the slit outer blade 40, the number of the first claws 51 in each slit body 50 may be three or less or five or greater. In the slit outer blade 40, each slit body 50 may include a plurality of second claws 52.

In the slit outer blade 40 of the embodiment, each slit body 50 includes four fitting portions 53. However, the number of the fitting portions 53 is not limited to that illustrated in the embodiment. In the slit outer blade 40, the number of the fitting portions 53 in each slit body 50 may be three or less or five or greater.

The slit outer blade 40 of the embodiment includes four first weld fixing portions 54. However, the number of the first weld fixing portions 54 is not limited to that illustrated in the embodiment. In the slit outer blade 40, the number of the first weld fixing portions 54 may be three or less or five or greater. The second weld fixing portions 55 may be modified in the same manner.

The comb component 60 of the embodiment is formed from a resin material. However, the material of the comb component 60 is not limited to that illustrated in the embodiment. For example, a modified example of the comb component 60 is formed from a metallic material.

In the comb component 60 of the embodiment, each comb wall 70 may exclude at least one of a first socket 74, a second socket 75, and a positioning portion 76.

In the comb component 60 of the embodiment, each comb wall 70 includes four first sockets 74 and one second socket 75. However, the number of each of the first sockets 74 and the second sockets 75 is not limited to that illustrated in the embodiment. In the comb component 60, the number of the first sockets 74 in each comb wall 70 may be three or less or five or greater. In the comb component 60, each comb wall 70 may include a plurality of second sockets 75.

The structure of the comb component 60 is not limited to that illustrated in the embodiment. For example, the comb teeth 72 may be arranged on only one of the comb walls 70. Some of the comb teeth 72 may be omitted. For example, one of the comb walls 70 may be omitted.

The dimension in the heightwise direction ZC of the comb component 60 does not have to be smaller than the dimension in the heightwise direction ZC of the slit outer blade 40. For example, the dimension in the heightwise direction ZC of the comb component 60 may be greater than or equal to the size in the heightwise direction ZC of the slit outer blade 40.

Each outer blade connector 90 of the embodiment may exclude at least one of the projection 93 and the accommodation hole 94.

The outer blade connectors 90 of the embodiment include four first welding portions 95. However, the number of the first welding portions 95 is not limited to that illustrated in the embodiment. The number of the first welding portions 95 in the outer blade connectors 90 may be one, two, three or five or greater. The second welding portions 96 may be modified in the same manner.

In the slit blade block 30 of the embodiment, the slit outer blade 40 includes the first claws 51. The comb component 60 includes the first sockets 74. However, the structure of the slit blade block 30 is not limited to that illustrated in the embodiment. For example, in a modified example of the slit blade block 30, the slit outer blade 40 includes the first sockets 74. The comb component 60 includes the first claws 51. The second claws 52 of the slit outer blade 40 and the second sockets 75 of the comb component 60 may be modified in the same manner.

In the slit blade block 30 of the embodiment, the slit outer blade 40 includes the fitting portions 53. The comb component 60 includes the positioning portions 76. However, the structure of the slit blade block 30 is not limited to that illustrated in the embodiment. For example, in a modified example of the slit blade block 30, the slit outer blade 40 includes the positioning portions 76. The comb component 60 includes the fitting portions 53.

In the slit blade block 30 of the embodiment, the weld fixing portions 54, 55 of the slit outer blade 40 are welded to the welding portions 95, 96 of the outer blade connectors 90 by heat sealing. However, the fixing structure of the slit outer blade 40 and the outer blade connectors 90 is not limited to that illustrated in the example. For example, in a modified example of the slit blade block 30, the slit outer blade 40 is fixed to the outer blade connectors 90 by bonding. Thus, a fixing process other than heat sealing may be used as long as the slit outer blade 40 can be fixed to the outer blade connectors 90.

In the slit blade block 30 of the embodiment, the dimension HA1 in the widthwise direction ZA of the comb teeth 72 is the same as the dimension HA2 in the widthwise direction ZA of the outer blade pieces 41. However, the proportion of the comb teeth 72 and the outer blade pieces 41 is not limited to that illustrated in the embodiment. For example, the dimension HA1 in the widthwise direction ZA of the comb teeth 72 may be smaller than the dimension HA2 in the widthwise direction ZA of the outer blade pieces 41.

In the slit blade block 30 of the embodiment, the distal surfaces 72C of the comb teeth 72 are located below the upper surfaces 41A of the outer blade pieces 41 of the slit outer blade 40. However, the positional relationship of the comb teeth 72 and the outer blade pieces 41 is not limited to that illustrated in the embodiment. For example, in the slit blade block 30, the distal surfaces 72C of the comb teeth 72 and the upper surfaces 41A of the outer blade pieces 41 may be at the same position in the heightwise direction ZC.

In the slit blade block 30 of the embodiment, the dimension L1 of the peaks 72D of the comb teeth 72 is smaller than the thickness L2 of the outer blade pieces 41. However, the proportion of the comb teeth 72 and the outer blade pieces 41 is not limited to that illustrated in the embodiment. For example, in the slit blade block 30, the dimension L1 of the peaks 72D of the comb teeth 72 may be the same as the thickness L2 of the outer blade pieces 41.

In the slit blade block 30 of the embodiment, the distal surfaces 72C of the comb teeth 72 are located above the lower surfaces 41B of the outer blade pieces 41. However, the positional relationship of the comb teeth 72 and the outer blade pieces 41 is not limited to that illustrated in the embodiment. For example, in the slit blade block 30, the distal surfaces 72C of the comb teeth 72 may be at the same position as the lower surfaces 41B of the outer blade pieces 41 in the heightwise direction ZC.

In the slit blade block 30 of the embodiment, the peaks 72D of the comb teeth 72 are located slightly below the lower surfaces 41B of the outer blade pieces 41. However, the position of the peaks 72D of the comb teeth 72 is not limited to that illustrated in the embodiment. For example, in the slit blade block 30, the peaks 72D of the comb teeth 72 may be located at the same position as the lower surfaces 41B of the outer blade pieces 41 in the heightwise direction ZC or below the lower surfaces 41B.

The slit blade block 30 of the embodiment is configured so that the slit inner blade 100 oscillates relative to the slit outer blade 40. However, the structure of the slit blade block 30 is not limited to that illustrated in the embodiment. For example, a modified example of the slit blade block 30 may have a rotary structure in which the slit inner blade 100 rotates relative to the slit outer blade 40.

The blade unit 20 of the embodiment includes two first blade blocks 21, two second blade blocks 24, and the slit blade block 30. However, the structure of the blade unit 20 is not limited to that illustrated in the embodiment. For example, at least one of a first blade block 21 and a second blade block 24 may be omitted. In a modified example, the blade unit 20 includes one first blade block 21, one second blade block 24, and the slit blade block 30. In another modified example, the blade unit 20 includes the slit blade block 30 and one of a first blade block 21 and a second blade block 24.

The electric razor 1 of the embodiment is of an oscillation type in which the first inner blades 23, the second inner blades 26, and the slit inner blade 100 oscillate. However, the electric razor 1 is not limited to the illustrated embodiment. For example, the electric razor 1 may be of a rotary type in which the inner blades 23, 26 and the slit inner blade 100 rotate.

The technical idea and the effect obtained from the above embodiments will now be described.

(a) The slit blade block according to any one of claims 1 to 3, wherein the comb component includes a comb wall adjacent to the slit outer blade, the comb wall includes a socket that projects toward the slit outer blade, and the slit outer blade includes a claw inserted into the socket.

In this structure, when an external force acts on the comb wall in a direction parting the comb wall from the slit outer blade, the socket and the claw contact each other. This prevents or limits movement or deformation of the comb wall in the direction parting from the slit outer blade.

The above description is to be considered as illustrative and not restrictive. The components disclosed in the embodiments may be assembled in any combination for embodying the present invention. For example, some of the components may be omitted from all components disclosed in the embodiments.

The invention claimed is:

1. A slit blade block of an electric razor, the slit blade block comprising:

a slit outer blade including a plurality of outer blade pieces;

a slit inner blade including a plurality of inner blade pieces, wherein when the slit inner blade, which is accommodated in the slit outer blade, moves relative to the slit outer blade, the outer blade pieces and the inner blade pieces cut hair; and a comb component including a plurality of comb teeth adjacent to the outer blade pieces, wherein:

each outer blade piece includes a basal surface opposed to the slit inner blade, and a distal surface located at a side opposite to the basal surface, each of the comb teeth includes a distal surface, and a projection that projects in a direction parting from the outer blade pieces, each projection includes a peak, which is an outermost end in the parting direction, the comb component includes a corner at a side opposite to the peak, the corner forming at least part of an upper opening of the comb component, the slit outer blade is received in the upper opening of the comb component, the distal surface of each projection and the corner are located between the distal surface and the basal surface of an adjacent one of the outer blade pieces, the distal surface of each of the comb teeth and the distal surface of the adjacent one of the outer blade pieces are flat surfaces substantially parallel to each other and form a height difference therebetween, and a dimension in a heightwise direction defined by the peak of each projection and the distal surface of the projection is less than or equal to a thickness of each outer blade piece defined by the distal surface and the basal surface of the outer blade piece.

2. The slit blade block according to claim 1, wherein the outer blade pieces are laid out in a layout direction, the outer blade pieces are respectively aligned with the comb teeth, and a width of each comb tooth in the layout direction is less than or equal to a width of each outer blade piece in the layout direction.

3. The slit blade block according to claim 1, wherein the comb component includes a projection piece that projects toward the slit outer blade, and the slit outer blade includes a fitting portion that is fitted to the projection piece.

4. An electric razor comprising the slit blade block according to claim 1.

5. The slit blade block according to claim 1, wherein the slit outer blade is formed from a first material, and the comb component is formed from a second material that is different from the first material.

6. The slit blade block according to claim 1, wherein the slit outer blade is a metallic member, and the comb component is a resin member.

* * * * *